US008357007B2

(12) United States Patent
Ihde et al.

(10) Patent No.: US 8,357,007 B2
(45) Date of Patent: Jan. 22, 2013

(54) WELDING CONTROL CABLE ASSEMBLY WITH STRAIN RELIEF

(75) Inventors: Jeffery Ray Ihde, Greenville, WI (US); James Francis Rappl, Neenah, WI (US); Thomas Don Lahti, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/026,776

(22) Filed: Feb. 14, 2011

(65) Prior Publication Data

US 2011/0244713 A1 Oct. 6, 2011

Related U.S. Application Data

(60) Provisional application No. 61/320,970, filed on Apr. 5, 2010.

(51) Int. Cl.
*H01R 13/58* (2006.01)

(52) U.S. Cl. ..... 439/455

(58) Field of Classification Search ..... 439/455, 439/453, 604

See application file for complete search history.

(56) References Cited

U.S. PATENT DOCUMENTS

| | | | | |
|---|---|---|---|---|
| 3,315,211 | A * | 4/1967 | Weeks, Jr. | 439/695 |
| 4,274,697 | A * | 6/1981 | Dodge et al. | 439/455 |
| 4,310,213 | A * | 1/1982 | Fetterolf et al. | 439/320 |
| 6,257,920 | B1 * | 7/2001 | Finona et al. | 439/455 |
| 2004/0185705 | A1 | 9/2004 | Wu | |

FOREIGN PATENT DOCUMENTS

FR 2854282 A1 10/2004

OTHER PUBLICATIONS

International Search Report for application No. PCT/US2011/024577 mailed Apr. 10, 2011.

* cited by examiner

*Primary Examiner* — Phuong Dinh
(74) *Attorney, Agent, or Firm* — Fletcher Yoder, P.C.

(57) ABSTRACT

A cable assembly with strain relief for providing welding control is provided. One welding control cable assembly includes a cable having a plurality of conductors configured to convey data and/or power in an insulative jacket. The cable assembly also includes a retainer bound to an outer surface of the insulative jacket adjacent to an end of the cable and a connector assembly having a plurality of connector elements in a housing. Each of the connector elements is terminated to a respective one of the conductors. The housing is disposed adjacent to the retainer. The assembly includes an overmolded shell disposed over the retainer and at least a portion of the connector assembly. At least the insulative jacket, the retainer and the overmolded shell cooperate to resist stress on the conductors by axial tensile forces placed on the connector assembly.

20 Claims, 6 Drawing Sheets

WELDING CONTROL CABLE ASSEMBLY WITH STRAIN RELIEF

CROSS REFERENCE TO RELATED APPLICATIONS

This application is a Non-Provisional Patent Application of U.S. Provisional Patent Application No. 61/320,970 entitled "Interconnecting Cable Strain Relief", filed Apr. 5, 2010, which is herein incorporated by reference.

BACKGROUND

The invention relates generally to welding systems and, more particularly, to a welding control cable assembly with strain relief.

Welding is a process that has become increasingly ubiquitous in various industries and applications. While such processes may be automated in certain contexts, a large number of applications continue to exist for manual welding operations. Such welding operations rely on a variety of types of equipment to ensure the supply of welding consumables (e.g., wire feed, shielding gas, etc.) is provided to the weld in an appropriate amount at the desired time. For example, metal inert gas (MIG) welding typically relies on a wire feeder to ensure a proper wire feed reaches a welding torch.

In such applications, welding power sources are utilized to provide power for such applications while wire feeders are used to deliver welding wire to a welding torch. Cables connect welding power sources to wire feeders and wire feeders to welding torches. Other welding equipment is also connected using cables. The cables may be pulled or flexed during normal welding operations. Strain relief arrangements may be added to cable connectors to decrease the possibility of cable conductors separating from the connectors and losing signal continuity. Unfortunately, current strain relief on the cable connectors may not be adequate to handle the forces applied to the cables. Accordingly, there exists a need for welding control cable assemblies that overcome such disadvantages.

BRIEF DESCRIPTION

In an exemplary embodiment, a welding control cable assembly includes a cable having a plurality of conductors configured to convey data and/or power in an insulative jacket. The cable assembly also includes a retainer bound to an outer surface of the insulative jacket adjacent to an end of the cable and a connector assembly having a plurality of connector elements in a housing. Each of the connector elements is terminated to a respective one of the conductors. The housing is disposed adjacent to the retainer. The assembly includes an overmolded shell disposed over the retainer and at least a portion of the connector assembly. At least the insulative jacket, the retainer and the overmolded shell cooperate to resist stress on the conductors by axial tensile forces placed on the connector assembly.

In another embodiment, a welding control cable assembly includes a cable having a plurality of conductors configured to convey data and/or power in an insulative jacket. The cable assembly also includes a male connector having a first retainer bound to an outer surface of the insulative jacket adjacent to a first end of the cable. The male connector also includes a first connector assembly having a plurality of first connector elements in a first housing. Each of the first connector elements is terminated to a respective one of the conductors. The first housing is disposed adjacent to the first retainer. The male connector includes a first overmolded shell disposed over the first retainer and at least a portion of the first connector assembly. The welding cable assembly also includes a female connector having a second retainer bound to an outer surface of the insulative jacket adjacent to a second end of the cable. The female connector includes a second connector assembly having a plurality of second connector elements in a second housing. Each of the second connector elements is terminated to a respective one of the conductors. The second housing is disposed adjacent to the second retainer. The female connector also includes a second overmolded shell disposed over the second retainer and at least a portion of the second connector assembly. At least the insulative jacket, the retainers and the overmolded shells cooperate to resist stress on the conductors by axial tensile forces placed on the connectors.

In another embodiment, a welding control cable assembly includes a cable having a plurality of conductors configured to convey data and/or power in an insulative jacket. The cable assembly also includes a retainer bound to an outer surface of the insulative jacket adjacent to an end of the cable. The welding control cable assembly includes a connector assembly having a plurality of connector elements in a housing. Each of the connector elements is terminated to a respective one of the conductors. The housing is disposed adjacent to the retainer and contacts the retainer. At least the insulative jacket, the retainer and the connector assembly cooperate to resist stress on the conductors by axial tensile forces placed on the connector assembly.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As described in detail below, embodiments of a welding control cable assembly with strain relief are provided that may enable increased resistance to axial tensile forces (i.e., pull forces) and increased flex cycles. For example, an embodiment of a welding control cable assembly may endure axial tensile forces of approximately 300, 450, 650, or 700 pounds and flex cycles greater than approximately 40,000, 55,000, 65,000, or 70,000. In one embodiment, the welding cable assembly includes a retainer bound to an outer surface of the insulative jacket adjacent to an end of the cable and a connector assembly having a plurality of connector elements in a housing. The housing is disposed adjacent to the retainer. The assembly includes an overmolded shell disposed over the retainer and at least a portion of the connector assembly. As such, at least the insulative jacket, the retainer and the overmolded shell cooperate to resist stress on conductors by axial tensile forces placed on the connector assembly.

Figure 1:
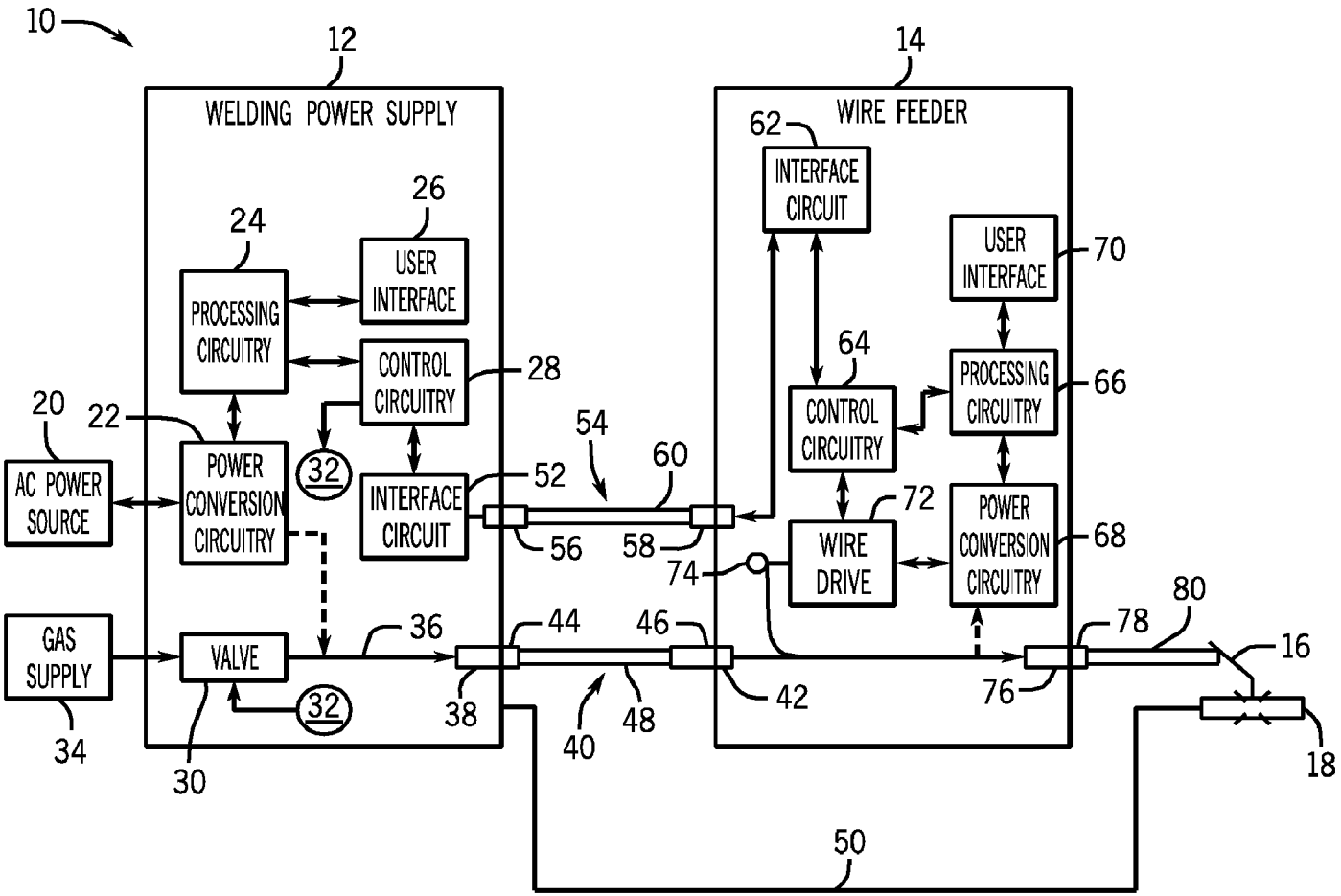
FIG. 1 is a schematic diagram of an exemplary welding system in accordance with aspects of the present invention.

Turning now to the figures, FIG. 1 is a schematic diagram of an exemplary welding system 10 which powers, controls, and provides supplies to a welding operation. The welding system 10 includes a welding power supply 12, a wire feeder 14, a torch 16, and a workpiece 18. The welding power supply 12 receives primary power from an alternating current power source 20 (e.g., the AC power grid, an engine/generator set, a battery, or other energy generating or storage devices, or a combination thereof), conditions the input power, and provides an output power to one or more welding devices in accordance with demands of the system 10. The primary power may be supplied from an offsite location (i.e., the primary power may originate from the power grid). Accordingly, the welding power source 12 includes power conversion circuitry 22 that may include circuit elements such as transformers, rectifiers, switches, and so forth, capable of converting the AC input power to a DCEP or DCEN output as dictated by the demands of the system 10. Such circuits are generally known in the art.

In some embodiments, the power conversion circuitry 22 may be configured to convert the primary power to both weld and auxiliary power outputs. However, in other embodiments, the power conversion circuitry 22 may be adapted to convert primary power only to a weld power output, and a separate auxiliary converter may be provided to convert primary power to auxiliary power. Still further, in some embodiments, the welding power supply 12 may be adapted to receive a converted auxiliary power output directly from a wall outlet. Indeed, any suitable power conversion system or mechanism may be employed by the welding power supply 12 to generate and supply both weld and auxiliary power.

The welding power supply 12 includes processing circuitry 24, a user interface 26, and control circuitry 28. The processing circuitry 24 controls the operations of the welding power supply 12 and may receive input from the user interface 26 through which a user may choose a process, and input desired parameters (e.g., voltages, currents, particular pulsed or non-pulsed welding regimes, and so forth). The control circuitry 28 may be configured to receive and process a plurality of inputs regarding the performance and demands of the system 10. Furthermore, the control circuitry 28 communicates with the processing circuitry 24 to control parameters input by the user as well as any other parameters. The control circuitry 28 may include volatile or non-volatile memory, such as ROM, RAM, magnetic storage memory, optical storage memory, or a combination thereof. In addition, a variety of control parameters may be stored in the memory along with code configured to provide a specific output (e.g., initiate wire feed, enable gas flow, etc.) during operation.

The welding power supply 12 may also include a valve 30 to modulate the amount of gas supplied to a welding operation. The valve 30 operates with signals via connection 32 from the control circuitry 28. A gas supply 34 may provide shielding gases, such as argon, helium, carbon dioxide, and so forth. The gas enters valve 30 then exits the valve through cable 36. As illustrated, the gas and power may be combined into the cable 36. As such, the cable 36 may supply the wire feeder 14 and the torch 16 with gas and power. However, it should be noted that in certain embodiments the gas and power may be provided in separate cables. The cable 36 is coupled to connector 38. The connector 38 may be a male or female box mounted connector that is mounted to the welding power supply 12.

A cable assembly 40 connects the welding power supply 12 to the wire feeder 14 via connecting to connector 38 on the power supply 12 and to a connector 42 on the wire feeder 14. Like connector 38, connector 42 may also be a male or female box mounted connector. The cable assembly 40 includes connectors 44 and 46 coupled to a cable 48. The connectors 44 and 46 may be male or female connectors sufficient that connectors 44 and 46 mate with connectors 38 and 42 respectively. A lead cable 50, which may be terminated with a clamp, couples the welding power supply 12 to the workpiece 18 to provide a return for welding power.

Data is communicated between the control circuitry 28 and an interface circuit 52. The interface circuit 52 conditions the data from the control circuitry 28 for communication to other welding devices, such as a wire feeder 14 and a pendant. Data conditioned in the welding power supply 12 is communicated to the wire feeder 14 over a control cable assembly 54. Power may also be transmitted over the control cable assembly 54. The control cable assembly 54 includes male connector 56 and female connector 58, each coupled to a cable 60. The connectors 56 and 58 may be male or female as needed to mate with the interface on the welding power supply 12 and the wire feeder 14.

The conditioned data is received by the wire feeder 14 and converted by an interface circuit 62 to signals compatible with a control circuitry 64 of the wire feeder 14. The interface circuit 62 may receive signals from control circuitry 64 for transmission to the welding power supply 12. The control circuitry 64 communicates with a processing circuitry 66. The processing circuitry 66 controls the functionality of the wire feeder 14 and is powered from a power conversion circuitry 68. The power conversion circuitry 68 may receive power from the combined gas and power cable, or from a separate power cable. The processing circuitry 66 may receive input from a user interface 70 through which a user may input desired parameters (e.g., voltages, currents, wire speed, and so forth). The wire feeder 14 includes a wire drive 72 that receives control signals from the control circuit 64 to drive a wire spool 74. Gas and power are transferred out of the wire feeder 14 through connector 76, which may be a male or female box mount connector. A connector 78 coupled to a cable 80 enable the gas and power to be provided to the torch 16 for a welding operation.

Figure 2:
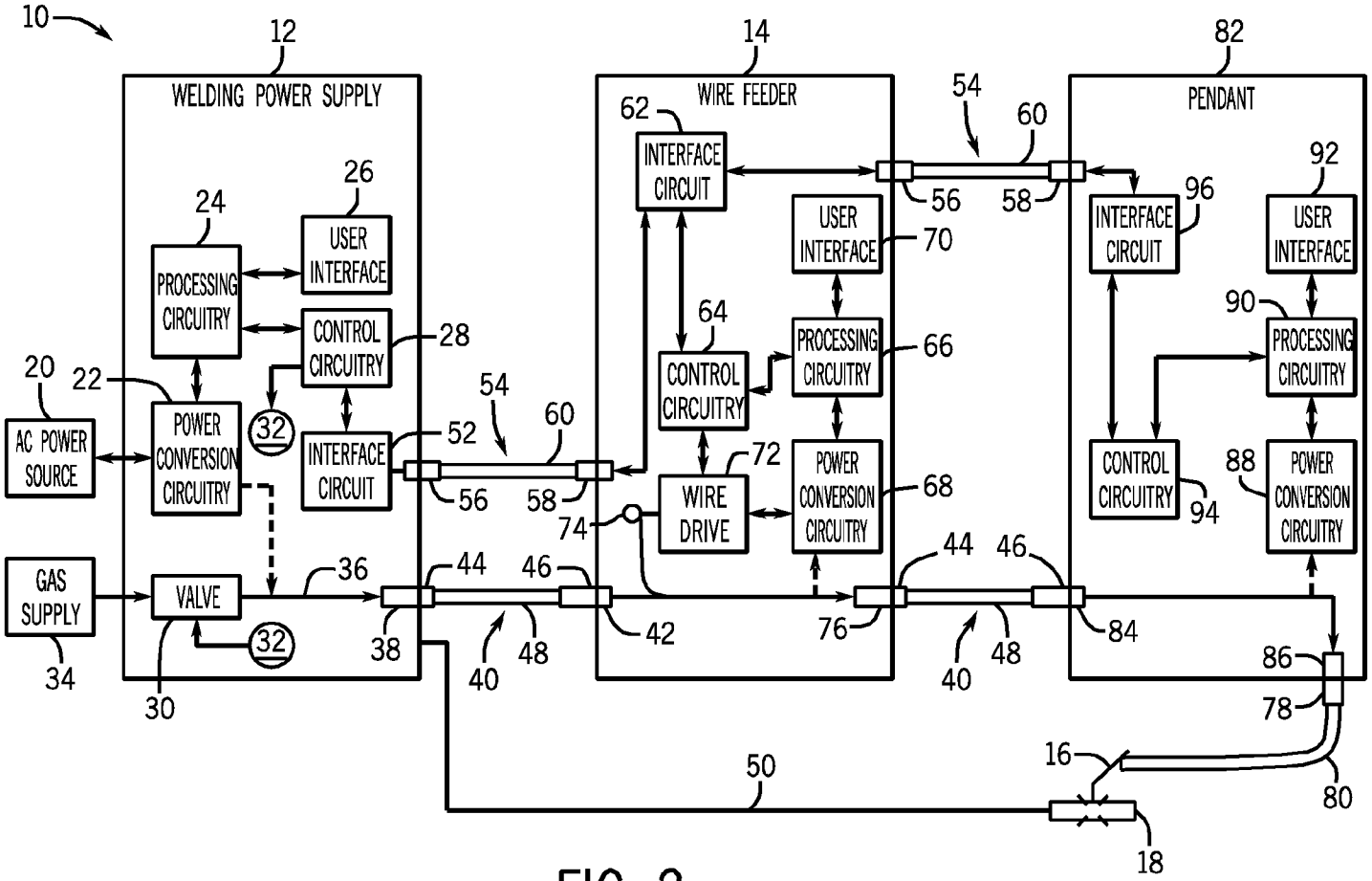
FIG. 2 is a schematic diagram of an exemplary welding system including a pendant in accordance with aspects of the present invention.

FIG. 2 is a schematic diagram of an exemplary welding system 10 including a pendant 82. The welding power supply 12, wire feeder 14, and torch 16 function in a similar manner as described in relation to FIG. 1. As illustrated, a second cable assembly 40 connects between connector 76 of the wire feeder 14 and connector 84 of the pendant 82. As previously described, gas and power may be carried by cable assembly 40. The gas and power exit the pendant 82 through connector 86 to provide gas and power to the torch 16. Connectors 84 and 86 may be box mount connectors and may be either male or female. The pendant 82 also includes a power conversion circuitry 88, processing circuitry 90, user interface 92, control circuitry 94, and interface circuit 96. The circuits and interfaces of the pendant 82 function in a similar manner to the similarly named circuits and interfaces previously described, thus controlling the operation of the pendant. A second control cable assembly 54 communicates control data and/or power between the wire feeder 14 and the pendant 82.

Figure 3:
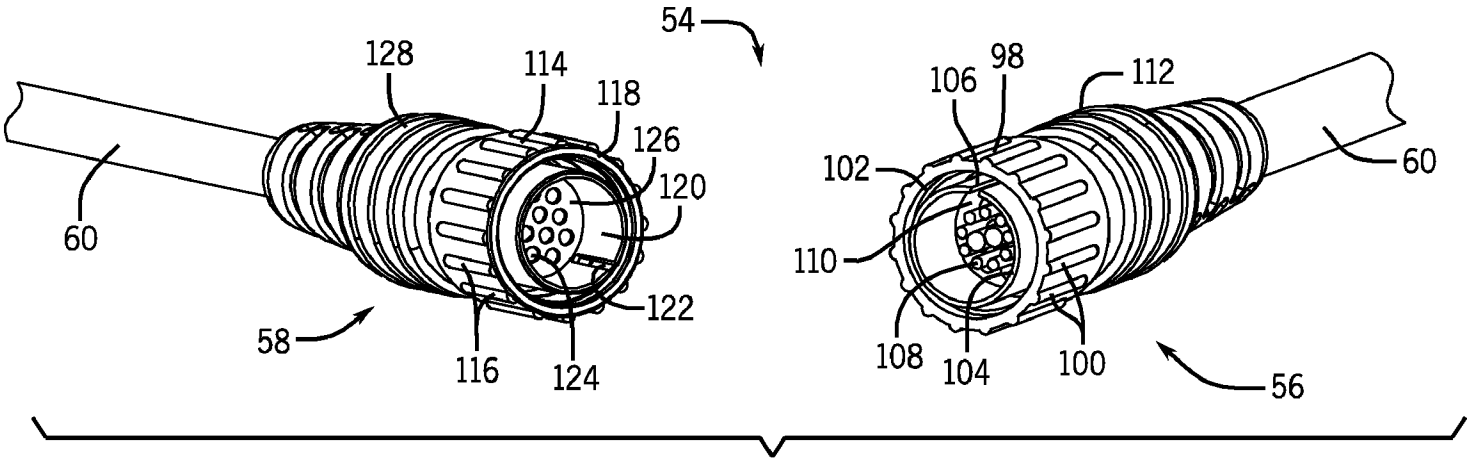
FIG. 3 is a perspective view of an embodiment of a welding control cable assembly.

FIG. 3 is a perspective view of an embodiment of a welding control cable assembly 54. The cable assembly 54 includes male connector 56 and female connector 58. The connectors 56 and 58 may be connected to each other by cable 60. In certain embodiments, the cable assembly 54 may include two male connectors or two female connectors. The male connector 56 includes a coupling ring 98. The coupling ring 98 has ridges 100 to enable a user to grip the connector 56 for mating to another connector. Furthermore, the coupling ring 98 has threads 102 that interface with the threads of a mating connector. The male connector 56 has a connector body 104 with an alignment notch 106. The connector body 104 operates as a housing for pins 108 and grommet 110. The grommet 110 surrounds the pins 108 and permits electrical isolation of the pins 108. The pins 108 are conductive connector elements for communicating data and/or power to a mating device. The pins 108 are terminated to wires from cable 60. An overmolded shell 112 is depicted behind the connector body 104 of the connector 56. The overmolded shell 112 covers a portion of the cable 60 and a portion of the connector 56.

The female connector 58 is constructed similar to the male connector 56. The female connector 58 includes a coupling ring 114 with ridges 116 and threads 118. The female connector 58 also has a connector body 120 having an alignment notch 122. The connector body 120 operates as a housing for sockets 124 and grommet 126. The grommet 126 surrounds the sockets 124 and permits electrical isolation of the sockets 124. The sockets 124 are conductive connector elements for communicating data and/or power to a mating device. The sockets 124 are terminated to wires from cable 60. An overmolded shell 128 is depicted behind the connector body 120 of the connector 58. The overmolded shell 128 covers a portion of the cable 60 and a portion of the connector 58.

Figure 4:
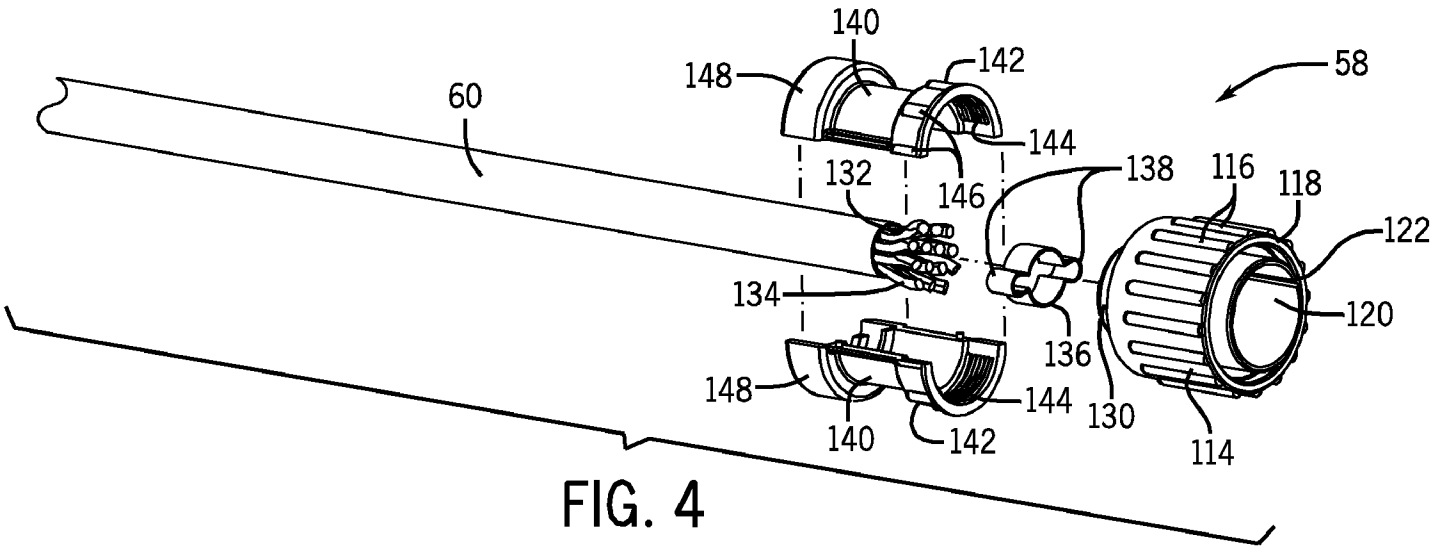
FIG. 4 is an exploded view of an embodiment of a female connector of a welding control cable assembly.

FIG. 4 is an exploded view of an embodiment of a female connector 58 of a welding control cable assembly. The coupling ring 114 is depicted together with the connector body 120. Threads 130 are depicted on the back end of the connector body 120. Cable 60 with its insulative jacket 132 removed depicts exposed wires 134. The wires 134 are each individually insulated. For the female connector 58 to be assembled, the exposed wires 134 are inserted into a clamp 136 or retainer having ears 138. In certain embodiments, the clamp 136 may be a compression ring, or any other retainer that can be securely attached to the cable 60. The clamp 136 is positioned to cover a location on the cable 60 that includes the insulative jacket 132. The ears 138 of the clamp 136 are crimped so that the clamp 136 is secured to the cable 60 and so that a portion of the insulative jacket 132 may be captured within the ears 138. The exposed wires 134 are attached to sockets (not shown) and installed within the connector body 120. After the exposed wires 134 are installed within the connector body 120, a barrier material is applied around the exposed wires 134 in the connector body 120. The material may be batting, a flexible washer, silicone, or RTV, for example. The barrier material protects the exposed wires 134 from contact with overmolding material that may be used. A collar 140 is positioned around the cable 60 and connected to the threads 130 of the connector body 120. A ring 142 is twisted to couple threads 144 to threads 130. The ring 142 includes ridges 146 to enable grip while twisting. The clamp 136 may be enclosed within a ring 148 of the collar 140. In certain embodiments, the clamp 136 is not enclosed within the collar 140. The collar 140 may have an internal taper that narrows an internal diameter such that the internal diameter at the ring 142 is greater than the internal diameter at the ring 148, or vice versa. Overmolding material may be applied over the collar 140 and/or the clamp 136.

Figure 5:
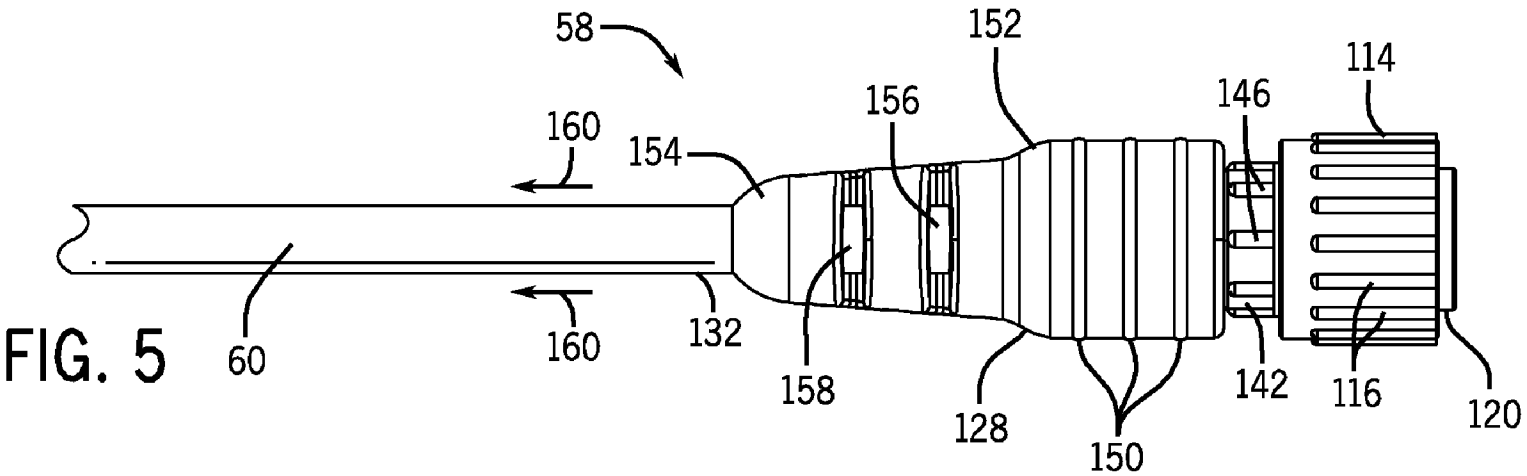
FIG. 5 is a side view of an embodiment of a female connector of a welding control cable assembly.

FIG. 5 is a side view of an embodiment of a female connector 58 of a welding control cable assembly. This illustration depicts the overmolded shell 128 covering a portion of the cable 60 and the collar leaving the ring 142 of the collar exposed. The overmolded shell 128 includes ridges 150, tapered areas 152 and 154 and openings 156 and 158. As may be appreciated, the overmolded shell 128 can be shaped in any manner to aid the insulative jacket 132 of the cable 60, the clamp and the overmolded shell 128 to cooperate to resist stress, such as tensile force 160, on the conductors. The overmolding material used for the overmolded shell 128 may be applied to the connector 58 using injection molding or any other suitable application process. The overmolding may be composed of any material that creates a bond between the cable 60, the clamp and a portion of the connector assembly. For example, the overmolding material may be composed of plastic, rubber, polymer, or another suitable material. When the overmolded shell 128 is created, the overmolding material fills any spaces beneath the collar in addition to covering the clamp, a portion of the cable, and a portion of the connector assembly. If the collar contains a taper, the overmolding material may coordinate with the taper to resister an increased tensile force 160.

Figure 6:
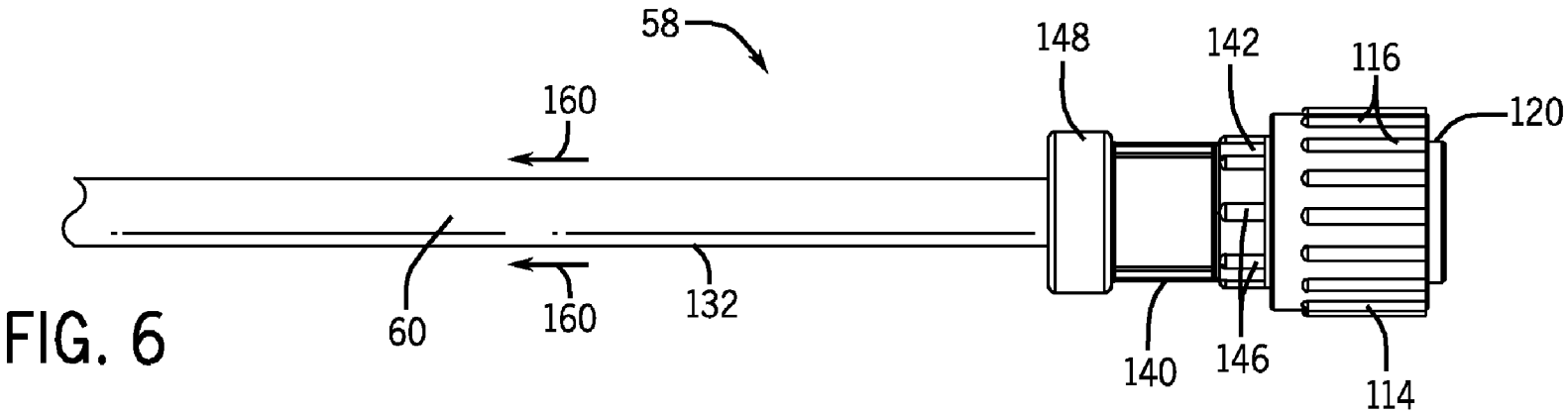
FIG. 6 is a side view of an embodiment of a female connector of a welding control cable assembly depicted without an overmolded shell.

FIG. 6 is a side view of an embodiment of a female connector 58 of a welding control cable assembly depicted without an overmolded shell. As such, the side view illustrated depicts how the female connector 58 may appear before the overmolded shell is applied. The coupling ring 114, connector body 120, collar 140 including rings 142 and 148, and the cable 60 are visible. The clamp is not visible, but is located beneath the ring 148. In certain embodiments, an overmolded shell may not be applied over the female connector 58.

Figure 7:
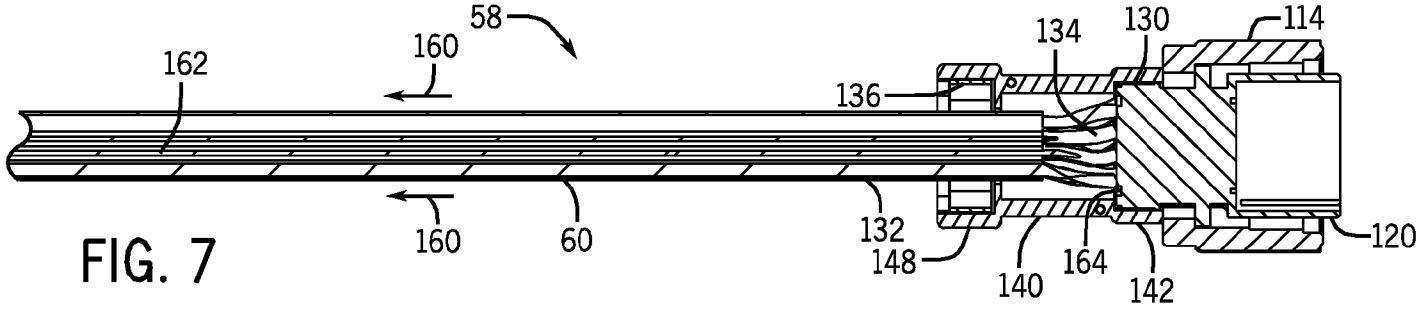
FIG. 7 is a cross-sectional view of the female connector of FIG. 6.

FIG. 7 is a cross-sectional view of the female connector 58 of FIG. 6. As described in FIG. 6, the clamp 136 is within the ring 148. Unexposed wires 162 are within the insulative jacket 132 of cable 60. The unexposed wires 162 extend into the collar 140 where the insulative jacket 132 ends. Exposed wires 134 then extend into the ring 142. Wire insulation is removed from the exposed wires 124 and the wires are inserted into the sockets within the connector body 120. A barrier material is inserted near location 164 to protect any uninsulated portions of the exposed wires 134. As previously described, the barrier material may be batting, a flexible washer, silicone, RTV, or other suitable material. When overmolding material is applied to the connector 58, the material enters the collar 140 near the ring 148 and fills any gaps within the collar 140. As such, the insulated portions of the exposed wires 134 may be surrounded by the overmolding material. Furthermore, the clamp 136 is surrounded by the overmolding material. Thus, each of the components surrounded by the overmolding material may cooperate together to increase the overall strength of the cable assembly. As may be appreciated, certain embodiments may not include the overmolding material. In such embodiments, the clamp 136 is positioned within the ring 148 and locks the cable 60 in place to resist stress caused by axial tensile forces 160.

Figure 8:
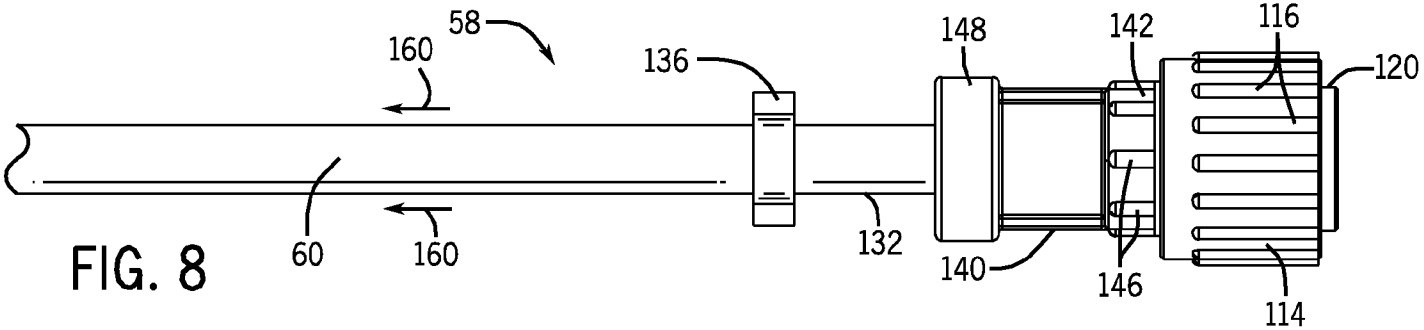
FIG. 8 is a side view of another embodiment of a female connector of a welding control cable assembly depicted without an overmolded shell.
Figure 9:
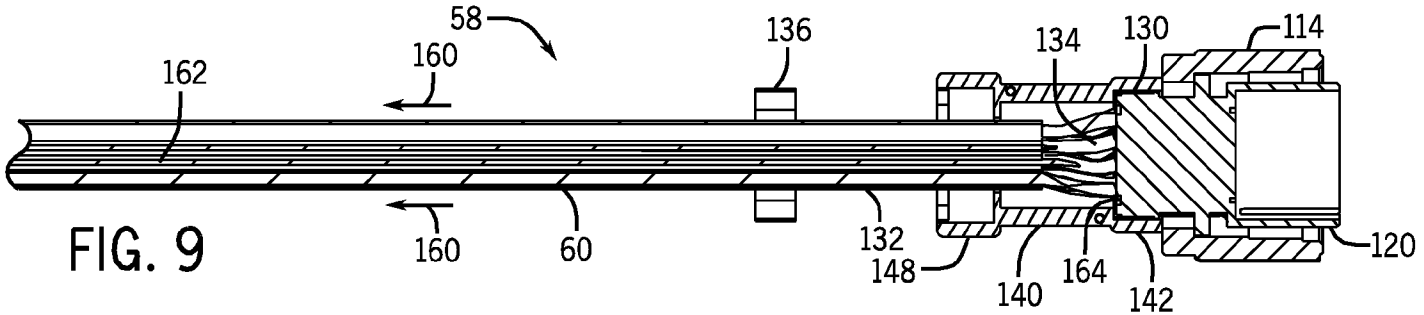
FIG. 9 is a cross-sectional view of the female connector of FIG. 8.

FIG. 8 is a side view of another embodiment of a female connector 58 of a welding control cable assembly depicted without an overmolded shell. In this embodiment, the clamp 136 is not enclosed by the collar 140. Therefore, the clamp 136 works in conjunction with the collar 140 to resist stress caused by axial tensile forces 160 when an overmolded shell is applied to cover the clamp 136 and at least a portion of the collar 140 portion of the connector assembly. FIG. 9 is a cross-sectional view of the female connector of FIG. 8 depicting that the clamp 136 is not located within the collar 140.

Figure 10:
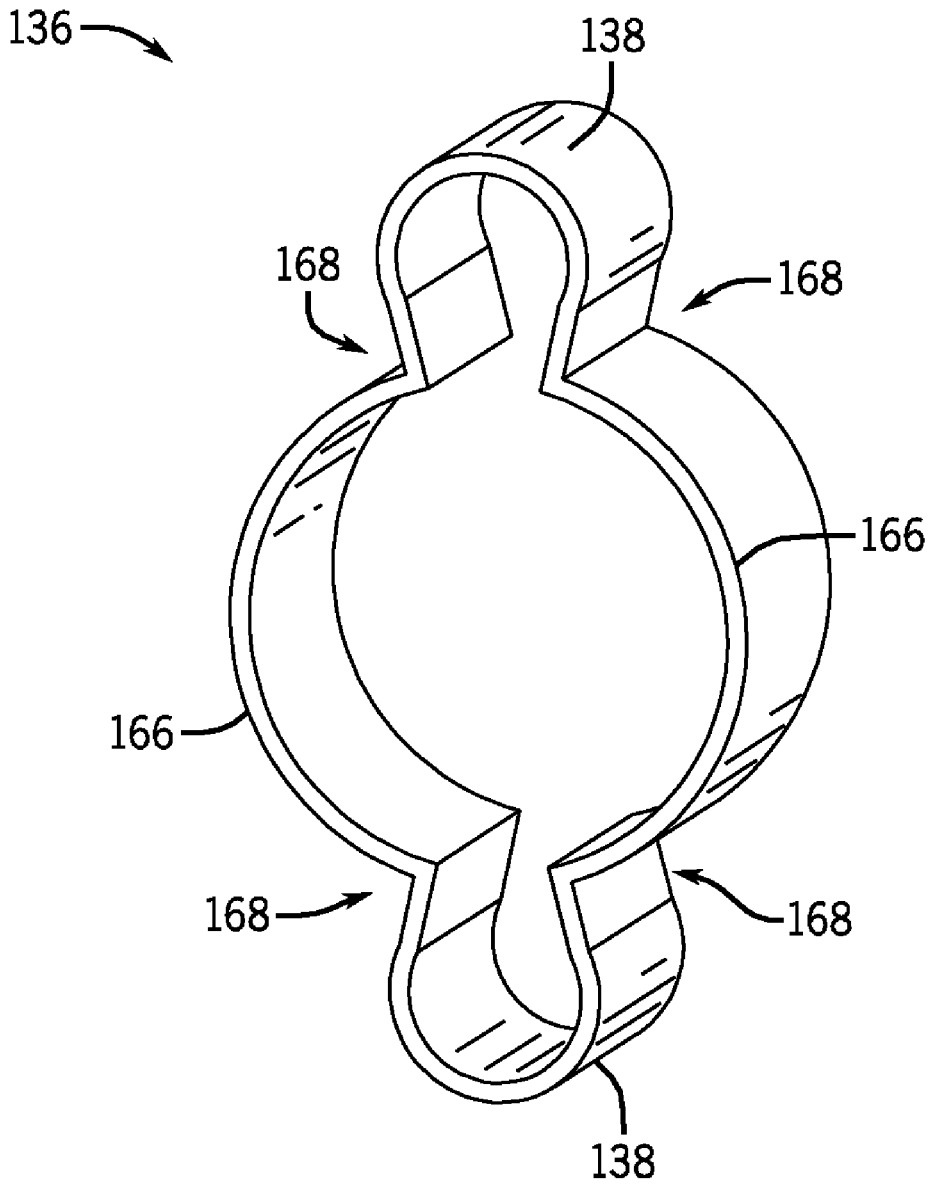
FIG. 10 is a perspective view of an embodiment of a clamp that may be part of a welding control cable assembly.

FIG. 10 is a perspective view of an embodiment of a clamp 136 that may be part of a welding control cable assembly. The clamp 136 has ears 138 and sides 166. To install the clamp 136 on a cable, the ears 138 are crimped at crimp locations 168. The ears 138 when crimped should enclose a portion of the insulative jacket of the cable. The clamp 136, such as the one depicted, may be purchased from McMaster-Carr, part number 6541K38. Furthermore, the clamp 136 may be installed using a straight-jaw pincer or a side-jaw pincer. It should be noted that other clamps may be used, such as other commercially available parts.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A welding control cable assembly comprising:

a cable comprising a plurality of conductors configured to convey data and/or power in an insulative jacket;

a retainer bound to an outer surface of the insulative jacket adjacent to an end of the cable;

a connector assembly comprising a plurality of connector elements in a housing, each of the connector elements terminated to a respective one of the conductors, the housing being disposed adjacent to the retainer, wherein the connector assembly comprises a collar threadingly coupled to the housing, and wherein the retainer is disposed within the collar; and an overmolded shell disposed over the retainer and at least a portion of the collar of the connector assembly such that the overmolded shell includes overmolding material disposed between the retainer and the collar to hold the retainer within the collar;

wherein at least the insulative jacket, the retainer and the overmolded shell cooperate to resist stress on the conductors by axial tensile forces placed on the connector assembly.

2. The assembly of claim 1, wherein the connector housing is disposed between the retainer and the end of the cable.

3. The assembly of claim 1, wherein the retainer is disposed between the connector housing and the end of the cable.

4. The assembly of claim 1, wherein the retainer is disposed in a ring portion of the collar of the connector assembly.

5. The assembly of claim 1, wherein the retainer comprises a ring that is compressed onto the outer surface of the insulative jacket.

6. The assembly of claim 1, wherein the retainer comprises a metallic ring that is crimped onto the outer surface of the insulative jacket.

7. The assembly of claim 1, wherein the connector elements comprise pins that are terminated to respective conductors of the cable.

8. The assembly of claim 1, wherein the connector elements comprise sockets that are terminated to respective conductors of the cable.

9. A welding control cable assembly comprising:

a cable comprising a plurality of conductors configured to convey data and/or power in an insulative jacket;

a male connector comprising a first retainer bound to an outer surface of the insulative jacket adjacent to a first end of the cable, a first connector assembly comprising a plurality of first connector elements in a first housing and a first collar threadingly coupled to the first housing, the first retainer being disposed within the first collar, each of the first connector elements terminated to a respective one of the conductors, the first housing being disposed adjacent to the first retainer, and a first overmolded shell disposed over the first retainer and at least a portion of the first collar of the first connector assembly such that the first overmolded shell includes overmolding material disposed between the first retainer and the first collar to hold the first retainer within the first collar; and a female connector comprising a second retainer bound to an outer surface of the insulative jacket adjacent to a second end of the cable, a second connector assembly comprising a plurality of second connector elements in a second housing and a second collar threadingly coupled to the second housing, the second retainer being disposed within the second collar, each of the second connector elements terminated to a respective one of the conductors, the second housing being disposed adjacent to the second retainer, and a second overmolded shell disposed over the second retainer and at least a portion of the second collar of the second connector assembly such that the second overmolded shell includes overmolding material disposed between the second retainer and the second collar to hold the second retainer within the second collar;

wherein at least the insulative jacket, the retainers and the overmolded shells cooperate to resist stress on the conductors by axial tensile forces placed on the connectors.

10. The assembly of claim 9, wherein the first connector assembly comprises a first barrier to inhibit the first overmolded shell from contacting the plurality of conductors terminated to the first connector elements and the second connector assembly comprises a second barrier to inhibit the second overmolded shell from contacting the plurality of conductors terminated to the second connector elements.

11. The assembly of claim 10, wherein the first barrier and the second barrier comprise batting.

12. The assembly of claim 10, wherein the first barrier comprises a first flexible washer and the second barrier comprises a second flexible washer.

13. The assembly of claim 10, wherein the first barrier and the second barrier comprise RTV.

14. The assembly of claim 9, wherein the first retainer and the second retainer comprise a metallic ring that is crimped onto the outer surface of the insulative jacket.

15. A welding control cable assembly comprising:

a cable comprising a plurality of conductors configured to convey data and/or power in an insulative jacket;

a retainer bound to an outer surface of the insulative jacket adjacent to an end of the cable; and a connector assembly comprising a plurality of connector elements in a housing, each of the connector elements terminated to a respective one of the conductors, the housing being disposed adjacent to the retainer, wherein the connector assembly comprises a collar threadingly coupled to the housing, and wherein the retainer is disposed within the collar;

wherein at least the insulative jacket, the retainer and the connector assembly cooperate to resist stress on the conductors by axial tensile forces placed on the connector assembly.

16. The assembly of claim 15, comprising an overmolded shell disposed over the retainer and at least a portion of the collar of the connector assembly such that the overmolded shell includes overmolding material being disposed between the retainer and the collar to hold the retainer within the collar, the overmolded shell cooperating to resist stress on the conductors by axial tensile forces placed on the connector assembly.

17. The assembly of claim 15, wherein the retainer comprises a ring that is compressed onto the outer surface of the insulative jacket.

18. The assembly of claim 15, wherein the retainer comprises a metallic ring that is crimped onto the outer surface of the insulative jacket.

19. The assembly of claim 15, wherein the connector elements comprise pins that are terminated to respective conductors of the cable.

20. The assembly of claim 15, wherein the connector elements comprise sockets that are terminated to respective conductors of the cable.

* * * * *